United States Patent [19]

Bendickson

[11] Patent Number: 5,067,588

[45] Date of Patent: Nov. 26, 1991

[54] LADDER LASH

[75] Inventor: Roy B. Bendickson, Greenville, Pa.

[73] Assignee: R. D. Werner Co., Inc., Greenville, Pa.

[21] Appl. No.: 506,459

[22] Filed: Apr. 9, 1990

[51] Int. Cl.[5] ..... E06C 5/36

[52] U.S. Cl. ..... 182/107; 182/93; 24/171; 24/194

[58] Field of Search ..... 182/93, 107, 206; 24/171 R, 172, 194, 196, 68 A, 68 E

[56] References Cited

U.S. PATENT DOCUMENTS 4,545,460 10/1985 Byrd ..... 182/93

4,792,016 12/1988 Ingalsbe ..... 182/93

*Primary Examiner*—Reinaldo P. Machado

*Attorney, Agent, or Firm*—Ansel M. Schwartz

[57] ABSTRACT

A system for holding a ladder in a secure position relative to an object against which the ladder rests. The system comprises a strap that contacts the ladder and the object and secures the ladder to the object. The system is also comprised of a first buckle and a second buckle, with each buckle being able to be placed at a desired position on the strap. Each end of the strap passes through a respective buckle and is positioned about a side rail of the ladder. The present invention also pertains to a buckle for holding a strap. The buckle comprises a first member having a first hole. Additionally, the buckle is comprised of a second member having a second hole. There is also a third member having a third hole. The third member is in sliding relationship with the first and second members such that the first side of the third member can slide over the first hole and contact the strap extending therethrough. A second side of the third member can slide over the second hole and contact the strap extending therethrough. Moreover, a third hole can be defined between the first and second members which the strap can extend and which the first and second members can hold when they slide toward each other along the third member.

6 Claims, 3 Drawing Sheets

LADDER LASH

FIELD OF THE INVENTION

The present invention is related to a ladder lash for holding a ladder secure against an object. More specifically, the present invention is related to a ladder lash which utilizes but one strap and which can be tightened from the ladder.

BACKGROUND OF THE INVENTION

Ladders are the simplest and easiest way to reach locations that are otherwise out of the reach of a person standing on the ground or floor. In situations where a ladder is used to reach a location that is at the top of, for instance, a telephone pole, or a location where there is only a wire or cable disposed in the air against which the ladder can lean, the ladder should be somehow secured in place. By the ladder being secured, the risk of the ladder twisting, tipping, bouncing or slipping during use is greatly lessened or essentially eliminated.

Ladder lashes have been used to provide this security between the ladder and a pole. Heretofore, ladder lashes have typically used several straps linked together. The fact that the strap is not one continuous piece raises the probability that the straps may separate at linkage points causing the secure relation between the ladder and the pole to disappear. In addition, ladder lashes currently available do not allow for the ladder lash to be tightened from the ladder to secure the ladder to the pole.

The present invention provides a ladder lash which utilizes but one strap which can be tightened from the ladder to secure the ladder to the pole.

SUMMARY OF THE INVENTION

The present invention pertains to a system for holding a ladder in a secure position relative to an object against which the ladder rests. The system comprises a strap that contacts the ladder and the object and secures the ladder to the object. The system is also comprised of a first buckle and a second buckle, with each buckle being able to be placed at a desired position on the strap. Each end of the strap passes through a respective buckle and is positioned about a side rail of the ladder. The present invention also pertains to a buckle for holding a strap. The buckle comprises a first member having a first hole. Additionally, the buckle is comprised of a second member having a second hole. There is also a third member having a third hold. The third member is in sliding relationship with the first and second members such that the first side of the third member can slide over the first hole and contact the strap extending therethrough. A second side of the third member can slide over the second hole and contact the strap extending therethrough. Moreover, a fourth hole can be defined between the first and second members through which the strap can extend and which the first and second members can hold when they slide toward each other along the third member.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
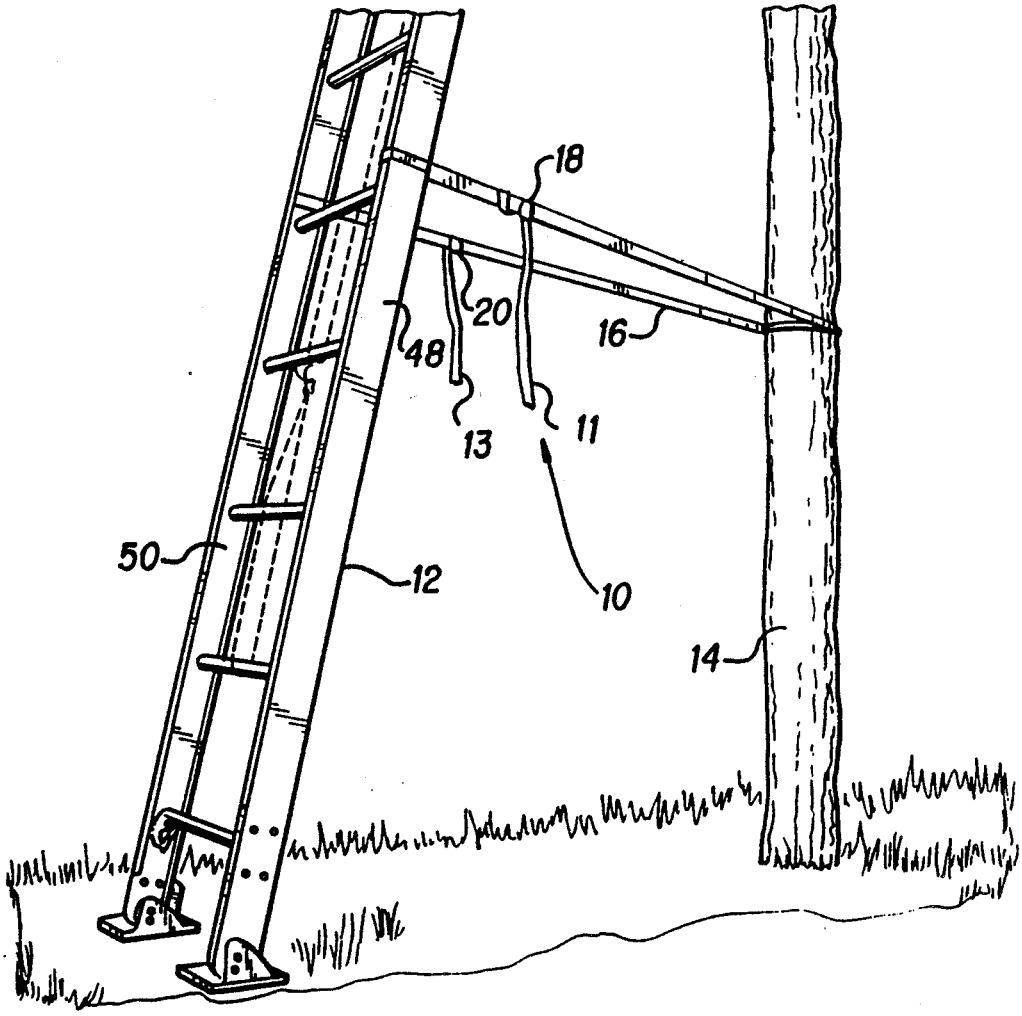
FIG. 1 is a schematic representation of a system for holding a ladder.

Referring now to the drawings wherein like reference numerals refer to similar or identical parts throughout the several views, and more specifically to FIG. 1 thereof, there is shown a schematic representation of a system 10 for holding a ladder 12 in a secure position relative to an object 14, such as a pole, against which the ladder 12 rests. The system 10 comprises a strap 16 that contacts the ladder 12 and the object 14 and secures the ladder 12 to the object 14. The system 10 is also comprised of a first buckle 18 and a second buckle 20. Each buckle 18, 20 is able to be placed in a desired position on the strap 16. Each end 11, 13 of the strap 16 passes through a respective buckle and is positioned about a side rail 48, 50 of the ladder 12. Preferably, the strap 16 can be tightened from the ladder 12 itself by pulling on each end of the strap 16 that has passed through its respective buckle.

Figure 2:
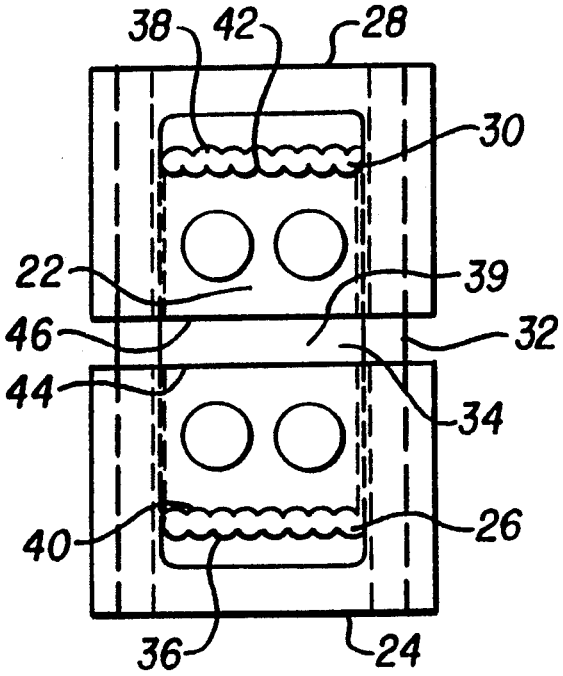
FIG. 2 is an overhead view of a buckle.
Figure 3:
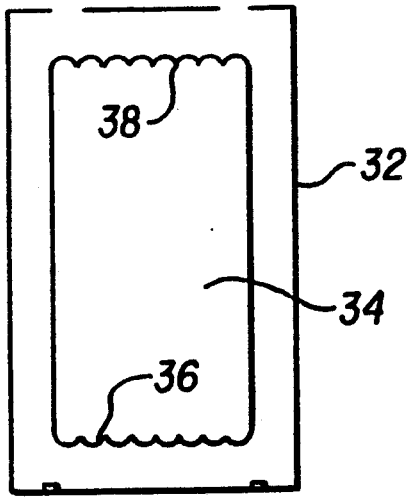
FIG. 3 is an overhead view of a third member of the buckle.

Referring to FIG. 2, there is shown a buckle 22 for holding a strap 16. The buckle 22 is comprised of a first member 24 having a first hole 26. The buckle 22 is also comprised of a second member 28 having a second hole 30. There is also a third member 32 having a third hole 34 as can better be seen in FIG. 3. The third member 32 is in sliding relationship with the first member 24 and second member 28 such that a first side 36 of the third member 32 can slide over the first hole 26 and contact the strap 16 extending therethrough, a second side 38 of the third member 32 can slide over the second hole 30 and contact the strap 16 extending therethrough, and a fourth hole 39 can be defined between the first member 24 and second member 28 through which the strap 16 can extend. The first member 24 and second member 28 can hold the strap 16 when they slide toward each other along the third member 32.

Figure 4:
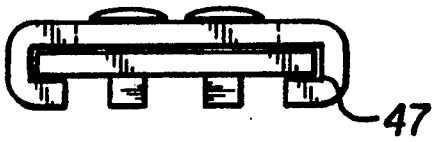
FIG. 4 is a side view of the buckle.

Preferably, the first member 24 has a first side 40 that opposes the first side 36 of the third member 32 in order for the strap 16 to be held therebetween. Preferably, the second member 28 has a first side 42 which opposes the second side 38 of the third member 32 in order for the strap 16 to be held therebetween. The first member 24 has a second side 44 and the second member 28 has a second side 46 which oppose each other as they slide along the third member 32. The first member 24, the second member 28 and the third member 32 are essentially rectangular, and the first hole 26, second hole 30, third hole 34 and fourth hole 39 are also essentially rectangular. The first member 24 and second member 28 each have a channel 47 in which the third member 32 is disposed as shown in FIG. 4.

The first side 40 of the first member 28 and the first side 36 of the third member 32 preferably each have teeth which complement each other. Similarly, the second side 38 of the third member 32 and the first side 42 of the second member 28 preferably each have teeth which complement each other. The presence of the teeth allow for a more secure grip of the strap that extends therethrough.

In the operation of the preferred embodiment, a ladder 12 is leaned against an object 14, such as a pole, and stabilized. The center of the strap 16 is placed on the nearest side of the pole relative to the ladder 12. It is positioned at the pole about shoulder height from the ground so that the user can easily work with the strap 16 and not place excessive side load on the ladder 12. Each end of the strap 16 is then wrapped once around the pole.

After each end of the strap 16 is wrapped around the pole once, the end of the strap 11 is passed through the first hole 26 of the first member 24 such that it is between the first side 36 of the third member 32 and the first side 40 of the first member 24. Next, the end of the strap 11 is passed through the fourth hole 39 such that the end of the strap 16 is between the second side 44 of the first member 24 and the second side 46 of the second member 28.

The end of the strap 11 is then brought about the first side rail 48 of the ladder 12 at about shoulder height from the ground. It is brought about the first side rail 48 from the inside of the side rail 48 to the outside and then brought back towards the first buckle 18. The end of the strap 16 is then passed through the second hole 30 of the second member 28 such that it passes between the second side 38 of the third member 32 and the first side 42 of the second member 28.

The same procedure is then followed with respect to the other end of the strap 13, the second buckle 20 and the second side rail 50 of the ladder 12. Each end of the strap 16 is gripped and pulled away from the pole in order to tighten the strap 16 and secure the ladder 12 to the pole.

When the end of the strap 11 is pulled away from the pole, the second side 38 of the third member 32 has a force applied to it from the strap 16 which causes the third member 32 to move in the channel 47 relative to the first member 24 and second member 28. Under this action, the second side 44 of the first member 24 is moved towards the second side 46 of the second member 28 causing the fourth hole 39 to become smaller and squeezing that portion of the strap 16 that is in the fourth hole 39.

Furthermore, the first side 36 of the third member 32 is then brought closer to the first side 40 of the first member 28 causing the first hole to become smaller and causing the portion of the strap 16 that is in between the first side 36 of the third member 32 and the first side 40 of the first member 24 to grip the strap 16. However, since the pulling of the end of the strap 16 causes the second end 38 of the first member 32 to move away from the first side 42 of the second member 28, that portion of the strap extending from the fourth hole 39 to the corresponding end of the strap 16 is not squeezed in the second hole 30. Consequently, any slack in the strap 16 between the fourth hole 39 and the corresponding end of the strap 16 is taken up under the pulling action, causing that portion of the strap 16 associated with the first buckle 18 and the first side rail 48 to become taught. This is also the situation for the other side of the strap 16 that passes through the second buckle 20 and second side rail 50.

For added security, a second system 10 can be used near the top of the ladder 12 after the system 10 is in place towards the bottom of the ladder 12.

Figure 5:
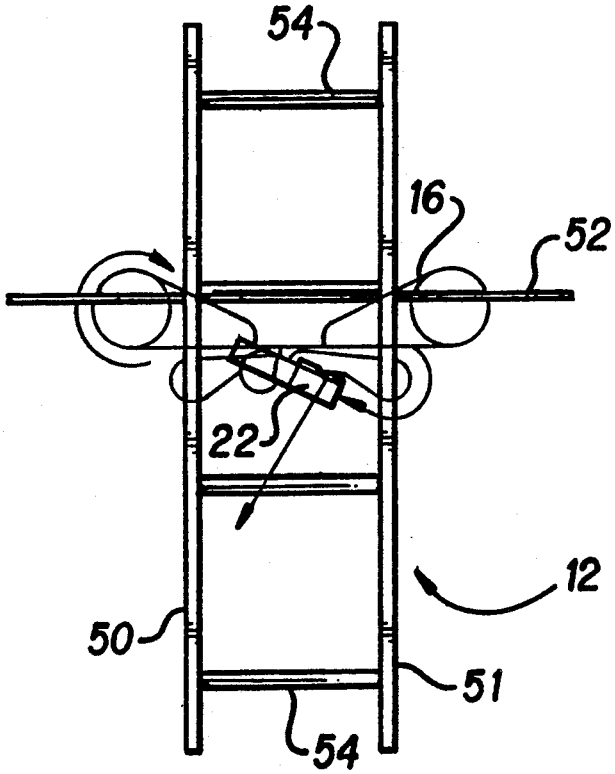
FIG. 5 is a perspective view of a ladder resting on a suspension strand.

If the ladder 12 is to be leaned against a suspension strand or cable, as shown in FIG. 5, the ladder 12 is first leaned against the strand 52 such that there are at least two ladder rungs 54 above the strand 52. The user then carefully climbs the ladder until he is facing the strand 52. Holding the strap 16 parallel to the strand 52 in front of himself and the ladder 12, each end of the strap 16 is wrapped about the strand at a point just outside of the ladder 12. The strap 16 is wrapped around the strand 52 twice. The end of the strap 16 is then passed through the first hole 26 and fourth hole 39 of the respective buckle 22 as described above with respect to the pole. After the end of the strap 16 is passed through the first buckle 22, it is passed around the second rail 50. The end of the strap 16 is then brought back to the first buckle 18 through the second hole 30 as described above. A similar procedure is followed for the other end of the strap 16, the second buckle 20 and the first side rail 51. The ladder 12 is then secured to the strand 52 with the same procedure as described above.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A system for holding a ladder in a secure position relative to an object against which the ladder rests comprising:

a strap that contacts the ladder and the object and secures the ladder to the object;

a first buckle and a second buckle with each buckle being able to be placed at a desired position on the strap, and each end of the strap passing through a respective buckle and positioned about a side rail of the ladder such that the strap can be tightened from the ladder by pulling each end of the strap that has passed through its respective buckle toward the ladder.

2. A buckle for holding a strap comprising:

a first member having a first hole;

a second member having a second hole;

a third member having a third hole, said third member in sliding relationship with the first and second members such that a first side of the third member can slide over the first hole and contact the strap extending therethrough, a second side of the third member can slide over the second hole and contact the strap extending therethrough, and a fourth hole can be defined between the first and second members through which the strap can extend and which the first and second members can hold when they slide toward each other along the third member.

3. A buckle as described in claim 2 wherein the first member has a first side that opposes the first side of the third member in order for the strap to be held therebetween, and the second member has a first side which opposes the second side of the third member in order for the strap to be held therebetween; and the first and second members each have a second side which oppose each other as they slide along the third member.

4. A buckle as described in claim 3 wherein the first, second and third members are essentially rectangular, and the first, second, third and fourth holes are essentially rectangular.

5. A buckle as described in claim 4 wherein the first side of the first member and the first side of the third member each have teeth which complement each other, and the second side of the third member and the first side of the second member each have teeth which complement each other.

6. A buckle as described in claim 5 wherein the first and second members each have a channel in which the third member is disposed.

* * * * *